United States Patent [19]

Hakoi

[11] 4,306,659

[45] Dec. 22, 1981

[54] AUTOMATIC SELECTION AND DELIVERY APPARATUS OF ASSEMBLED MECHANICAL PARTS

[75] Inventor: Tsutomu Hakoi, Kurobe, Japan

[73] Assignee: Yoshida Kogyo K.K., Tokyo, Japan

[21] Appl. No.: 106,042

[22] Filed: Dec. 21, 1979

[30] Foreign Application Priority Data

Dec. 26, 1978 [JP] Japan ..... 53-161534

[51] Int. Cl.[3] ..... B07C 5/00; B07C 9/00

[52] U.S. Cl. ..... 209/688; 209/929; 209/940; 414/223; 414/908

[58] Field of Search ..... 209/929, 940, 688, 600–601, 209/619; 414/14, 908, 223

[56] References Cited

U.S. PATENT DOCUMENTS 1,421,715 7/1922 Puc ..... 209/929 X 2,355,280 8/1944 Dichter ..... 209/688 X 2,781,126 2/1957 Wood ..... 209/600

*Primary Examiner*—Charles A. Marmor

*Attorney, Agent, or Firm*—Hill, Van Santen, Steadman, Chiara & Simpson

[57] ABSTRACT

Disclosed is an automatic selection and delivery apparatus adapted to discriminate between correctly and incorrectly assembled bodies consisting of a plurality of assembled parts and at the same time deliver to a delivery chute only those bodies which have been assembled correctly. This is accomplished through a detection operation performed by a delivery pin which scans recesses that are provided in a base to accommodate the assembled bodies, the delivery pin being adapted to detect a through-hole which will exist only in a correctly assembled body.

4 Claims, 4 Drawing Figures

AUTOMATIC SELECTION AND DELIVERY APPARATUS OF ASSEMBLED MECHANICAL PARTS

FIELD OF THE INVENTION

This invention relates to an apparatus for delivering automatically from a prescribed position an assembled body, composed of a plurality of assembled mechanical elements, upon automatically selecting between assembled bodies which have and have not been correctly assembled.

The automatic selection and delivery practiced in the present invention is performed by detecting the absence or presence of a specific through-hole which an assembled body must possess if the body has been assembled correctly.

CROSS-REFERENCE TO OTHER APPLICATION

In an application U.S. Ser. No. 105,939 filed separately under the same date as that of the application of the present invention, the present inventor discloses an automatic selection and delivery apparatus which automatically delivers assembled bodies upon automatically selecting between assembled bodies which have and have not been correctly assembled, this being accomplished, in contradistinction to the present invention, by detecting the absence or presence of a specific projection which an assembled body must possess if the body has been assembled correctly.

BRIEF SUMMARY OF THE INVENTION

It is a general object of the present invention to provide an automatic selection and delivery apparatus which has a comparatively simple structure but which combines the twin functions of selection and delivery applied to assembled bodies, this being accomplished by utilizing an automatic delivery operation in selecting among bodies which have and have not been assembled correctly.

A more specific object of the present invention is to provide an automatic selection and delivery apparatus adapted to detect, by means of a swinging delivery pin, the absence or presence of a through-hole which an assembled body must possess if it has been assembled correctly, this absence or presence of the through-hole serving as a standard for discriminating between bodies assembled satisfactorily and those which have been assembled incorrectly, and also to guide to a prescribed delivery path, simultaneously the detection of the specific through-hole, by the swinging motion of the delivery pin, a correctly assembled body as indicated by the presence of the specific through-hole.

Other objects, effects and features of the present invention will be apparent from the following description of a preferred embodiment taken in conjunction with the following drawings.

DETAILED DESCRIPTION OF THE PREFERRED EMBODIMENT

Figure 1:
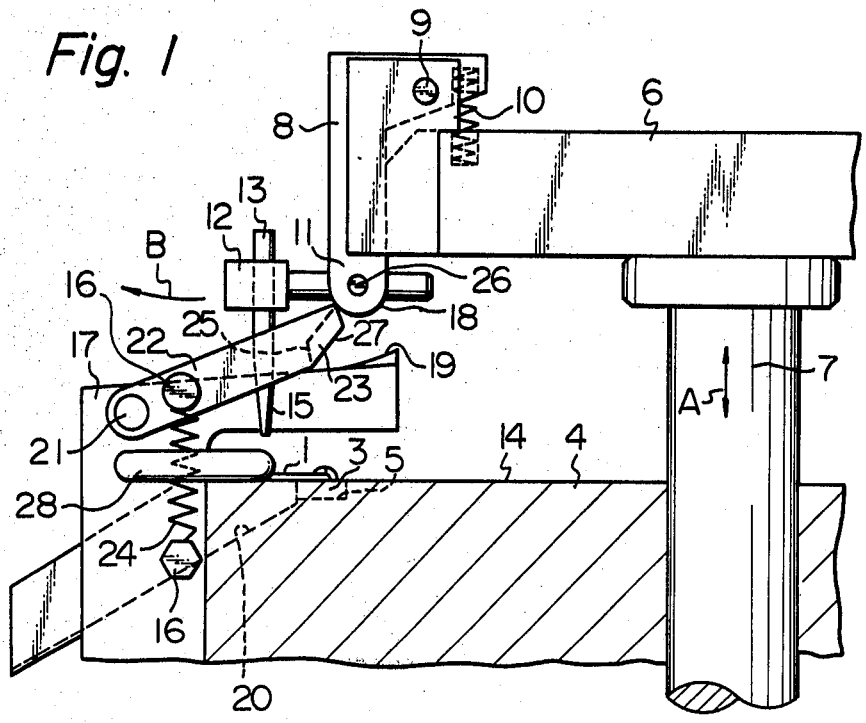
FIG. 1 is a longitudinal sectional view showing an essential portion of an embodiment of the present invention.
Figure 2:
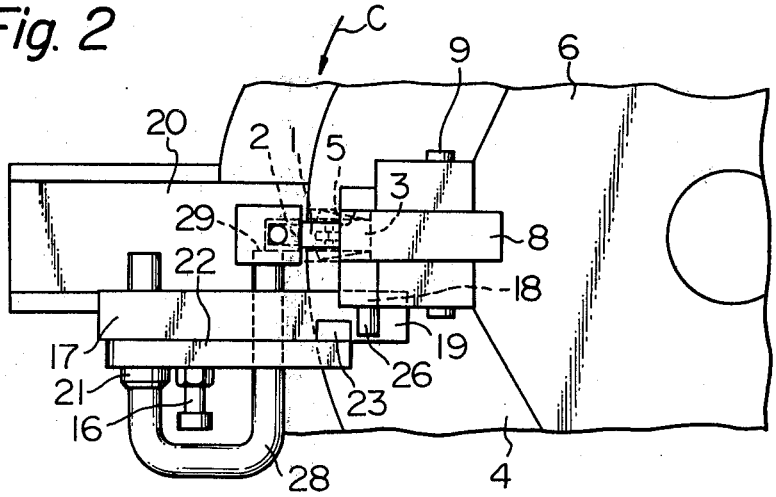
FIG. 2 is a plan view of the embodiment of FIG. 1.
Figure 3:
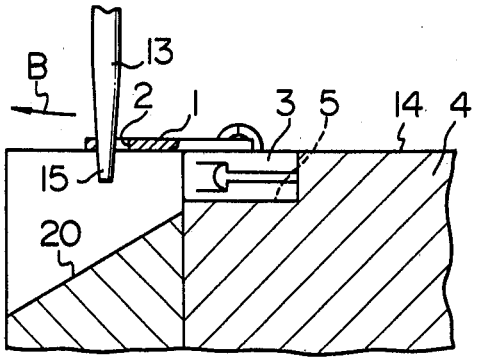
FIG. 3 is an enlarged cross-sectional view of a delivery pin shown in an operational state.
Figure 4:
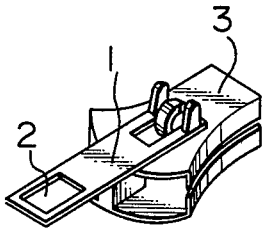
FIG. 4 is an enlarged perspective view of a slide fastener slider as one example of an assembled body.

Illustrated in FIGS. 1 through 3 is an embodiment for a case in which the automatic selection and delivery apparatus of the present invention is applied to equipment used in the manufacture of sliders for slide fasteners. A completed slider is shown in FIG. 4 and comprises a pull tab 1 attached to a slider body 3. In the present embodiment the slider is treated as the assembled body subjected to the selection and delivery process described above. Accordingly, a slider body to which the pull tab 1 has not been attached must be selected as an imperfectly assembled body and rejected from those bodies which have been assembled correctly.

The apparatus of the present embodiment includes a disk-shaped base 4 arranged so as to be rotated step-wise at a fixed angular pitch, the outer edge of the upper surface of the base 4 being provided with a plurality of equally spaced apart recesses 5, . . . for receiving parts. Various pieces of equipment are arranged about the base 4 at positions corresponding to the recesses 5, . . . when the base is at rest, such equipment including element supply means for providing the elements that constitute the slider body, element finishing means, means for supplying a pull tab 1 to a finished slider body, means for caulking the portion at which the pull tab is attached, and automatic delivery means. In accordance with such an arrangement, slider body elements accommodated in respective ones of the recesses 5 are shifted from one machining stage to the next to undergo successive machining processes each time the disk-shaped base 4 is indexed or rotated by the fixed angular pitch, a completed slider being obtained at the final stage where the pull tab is caulked to the slider body. However, there are occasions where a malfunction in the pull tab supply means or pull tab caulking means can prevent a pull tab from being attached to a slider body, with the result that a slider to which a pull tab has not been attached manages to be indexed to the position of a delivery path.

The automatic selection and delivery apparatus of the present invention is adapted to deliver a correctly assembled slider by means of a delivery pin 13 which delivers the slider only when it has been correctly assembled, after discriminating between sliders which have or have not been assembled correctly, the delivery pin operating to deliver the slider which is accommodated in a recess located at the position of the automatic delivery means.

The illustrated automatic selection and delivery apparatus has a bracket 6 adapted to be driven toward or away from the upper surface 14 of the base 4, the bracket being fixedly secured to a drive shaft 7 reciprocated intermittently in the direction indicated by the arrow A by means of a driving source which is not shown. A delivery arm 8 having an inverted L-shaped cross-section extends down toward the base 4 and is pivotally secured for swinging motion to the bracket 6, the arm end 11 being constantly biased toward the side of the bracket 6 by means of a spring 10. Fixedly secured to the arm end 11 via a second mounting bracket 12 is a delivery pin 13 which extends down toward the upper surface 14 of the base.

In accordance with the advancing and retracting motion of the bracket 6, the tip 15 of the delivery pin 13 reciprocates between a first position, shown in FIG. 1, where it clears the upper surface 14 of the base, and a second position, shown in FIG. 3, where it extends below the upper surface of the base.

Provided adjacent the base 4 is a guide bar 17 whose upper surface 19 is disposed at a position between the bracket 6 and the upper surface 14 of the base where it will be struck by the lower end surface 18 of the delivery arm 8. The lower end surface 18 defines a rounded convexity and the upper surface 19 an arcuate concavity so that, where the surfaces meet, the upper surface 19 acts as a guiding surface that swings the delivery arm 8 against the force of the spring 10 in the direction indicated by the arrow B which is counter to the direction of the biasing force. In addition, the arrangement is adjusted so that the delivery pin 13 when lowered vertically will arrive at the second position shown in FIG. 3 at the time that the lower end surface 18 and upper surface 19 come into abutting contact. Accordingly, after the tip 15 of the delivery pin 13 assumes the position shown in FIG. 3 by descending vertically toward the upper surface 14 of the base from the position shown in FIG. 1, the lower end surface 18 is guided by the upper surface 19 so that the tip of the delivery pin is caused to swing in the direction indicated by arrow B in FIGS. 1 and 3 and then, upon retraction of the bracket 6, is again allowed to return to the position shown in FIG. 1. A recess 5 accommodating an assembled slider 3, and a slider delivery chute 20 in communication with the recess, are positioned in and along the path traced by the swinging delivery pin on the base 4 and the frame, respectively. Moreover, the starting point of this path traced by the tip 15 of the swinging delivery pin 13 is a point at which the tip 15 has been lowered vertically by the action of the bracket 6, with the dimensions and mounted positions of the associated parts being adjusted so that the starting point will agree with a position located below the through-hole 2 in the pull tab 1 of a slider 3 which has been received in the recess 5.

Owing to the swinging motion described above, the tip 15 of the delivery pin 13 pulls the pull tab 1 of slider 3 in the direction indicated by the arrow B, whereby the slider 3 is pulled out of the recess 5 and then allowed to slidably fall into the slider delivery chute 20.

The illustrated embodiment features the addition of a guide cam to assure that the tip 15 of the delivery pin 13 separates from the through-hole 20 in the pull tab 1. More specifically, a cam rod 22 pivotally mounted on the side surface of the guide bar 17 via a shaft 21 has a guide cam 23 fixedly secured at the side of its free end. The guide cam 23 rests on the upper surface 19 of the guide bar 17 with the lower edge of the cam held resiliently against the upper surface 19 at all times by means of a spring 24 both ends of which are fixed by bolts 16, 16. The guide cam 23 has a rhomboid cross-section whose short side 25 is oriented substantially along a vertical line. The arm end 11 of the delivery arm 8, on the other hand, is provided with a projecting pin 26 made to engage the guide cam 23. More specifically, the pin 26 engages the long side 27 and the short side 25 of the guide cam 23 when the delivery pin 13 swings as described above.

Accordingly, when the lower end surface 18 of the delivery arm 8 swings in the direction B along the upper surface 19 of the guide bar 17 with the guide cam 23 held in resilient contact with the upper surface 19 owing to the resilient force of the spring 24, the pin 26 abuts against the long side 27 of the guide cam 23, raises the guide cam and hence the cam bar 22, and then gradually escapes from under the guide cam. When this occurs the guide cam 23 is once again brought into abutting contact with the upper surface 19 of the guide bar 19 owing to the action of spring 24. Once this state has been attained the bracket 6 enters its upward stroke with the delivery arm 8 being urged toward the side of bracket 6 by spring 10. Although the tip 15 of delivery pin 13 attempts to swing back retracing the path described by its swinging motion, this is prevented by the short side 25 of guide cam 23 which obstructs their backward movement of the delivery pin. As a result, the tip 15 moves upward along a substantially vertical line by sliding along the short side 25 and is separated from the through-hole 2 in pull tab 1 in a rapid and reliable manner.

In FIGS. 1 and 2, a U-shaped fixture 28 serves as a position adjustment member mounted on guide bar 17 so as to lie in parallel with the upper surface 14 of the base, and has one end 29 disposed in front of the slider accommodating recess 5 so that it will abut against the side of the pull tab 1 when the base 4, rotating in the direction C, comes to a stop and hence carries the slider accommodating recess 5 to a position immediately below the automatic delivery apparatus of the present invention. Thus, the end 29 by abutting against the pull-tab 1 positions the latter where it can be operated on by the tip 15 of the delivery pin 13.

It can be understood from the foregoing description of a preferred embodiment that the present invention combines the reciprocating motion and swinging motion of the delivery pin 13 and utilizes the through-hole 2 in a correctly assembled body to select and deliver the assembled body (i.e., the slider 3). If the recess 5 accommodates an assembled body which is unsatisfactory because it fails to possess a mounted member (the pull tab 1) having the through-hole, delivery of the unsatisfactory assembled body cannot take place. Hence, in accordance with the present invention, unsatisfactory items included among the sliders cannot be mixed with correctly assembled sliders and delivered from the same delivery chute. In other words, selection and delivery are performed simultaneously.

The present invention as described above makes it possible to realize automatic selection and delivery of correctly assembled bodies (sliders in the preferred embodiment) merely by inserting a delivery pin into a through-hole provided in the correctly assembled body, and then manipulating the delivery pin so as to pull the body in the delivery direction. In doing so, the delivery member and associated operating parts do not contact the assembled body at any portion other than the through-hole, so that there is no possibility of flawing the assembled body surface. Moreover, the delivery operation involves simple reciprocating motion of a bracket by means of a driving source, while the direct delivery action is accomplished by the swinging motion of the delivery pin owing to abutting contact between a pair of guiding surfaces. This makes possible a highly reliable automatic delivery operation with a simple mechanism whose transmission system is not likely to malfunction, and with an overall construction which is comparatively uncomplicated.

What is claimed is:

1. An automatic selection and delivery apparatus of assembled mechanical parts which comprises:

a base having a disk-shaped configuration and being provided about its circumference with a plurality of recesses spaced apart at a fixed angular pitch for receiving assembled bodies, the correctness of which are to be detected;

said base being rotated step-wise by said fixed angular pitch;

a delivery pin having an end for engaging a through-hole which will exist in a correctly assembled body but not in an incorrectly assembled body; and said delivery pin being driven radially of said disc-shaped base along one of said recesses in said base whenever said base comes to a stop.

2. An automatic selection and delivery apparatus according to claim 1, which further includes a bracket reciprocated vertically to advance toward and retract from said base when said base comes to a stop, a guide bar disposed between said bracket and the upper surface of said base, and a delivery pin pivotally mounted on said bracket for swinging motion under the guidance of the surface of said guide bar, wherein said delivery pin is swung under the guidance of the surface of said guide bar as said bracket is advanced, whereby detection of the correctness of the assembled bodies accommodated in said recesses, which correctness is detected on the basis of whether or not said assembled bodies possess a through-hole, and the delivery of correctly assembled bodies are carried out simultaneously.

3. An automatic selection and delivery apparatus according to claim 2, in which a spring for biasing said delivery pin in the direction opposite to the direction of the swinging motion thereof is disposed between said delivery pin and said bracket.

4. An automatic selection and delivery apparatus according to claim 2 or claim 3, which further includes a cam rod pivotally mounted on said guide bar and biased by a spring in the direction of advance of said bracket, said cam rod having a cam of a rhomboid cross-section on the side of its free end; and a pin member swingable together with said delivery pin; wherein when said pin member escapes from under the one side of said cam of rhomboid cross-section as said delivery pin swings, another side of said cam of rhomboid cross-section prevents the swinging motion of said delivery pin and constrains said delivery pin to move upward along a substantially vertical line as said bracket retracts, whereby said delivery pin is rapidly separated from the through-hole in the assembled body.

* * * * *